United States Patent [19]

Johnson

[11] 4,330,216

[45] May 18, 1982

[54] GRAVITY-INDUCED STIRRING DEVICE FOR ROTATING LIQUID CONTAINERS

[75] Inventor: Luther R. Johnson, Thousand Oaks, Calif.

[73] Assignee: Becton, Dickinson and Company, Paramus, N.J.

[21] Appl. No.: 208,979

[22] Filed: Nov. 21, 1980

[51] Int. Cl.[3] ..... B01F 9/08

[52] U.S. Cl. ..... 366/222; 366/224; 366/233; 366/235; 435/285

[58] Field of Search ..... 366/200, 201, 213, 214, 366/220, 221, 223, 222, 224, 230, 231, 233, 235, 309, 311, 312, 313, 280; 435/284, 285, 286

[56] References Cited

U.S. PATENT DOCUMENTS

| | | | |
|---|---|---|---|
| 3,083,081 | 3/1963 | Sharp | 366/224 |
| 3,740,321 | 6/1973 | Pagano | 435/285 |
| 3,911,619 | 10/1975 | Dedolph | 435/285 |
| 3,975,239 | 8/1976 | Stamer | 366/213 |
| 4,238,568 | 12/1980 | Lynn | 435/285 |

*Primary Examiner*—Robert W. Jenkins

*Attorney, Agent, or Firm*—Richard J. Rodrick

[57] ABSTRACT

A device for stirring liquid in a rotating container includes a movable stirrer adapted to be positioned inside a rotatable container and to impart stirring movement to liquid placed therein. A gravity-induced stirring mechanism is associated with the container and the stirrer for moving the stirrer with the container for only a portion of a revolution of the container when rotating. This mechanism permits the increasing gravitational force thereon due to rotation to discontinue the movement of the stirrer and cause a gravitational rotation of the stirrer in a counter-direction to that of the rotating container whereby liquid inside the container is stirred.

12 Claims, 6 Drawing Figures

FIG.2
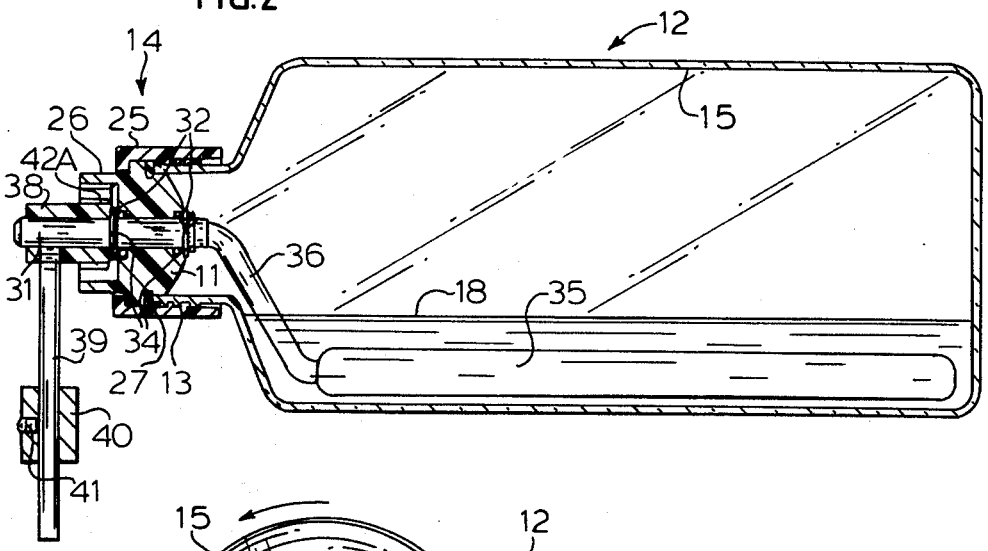
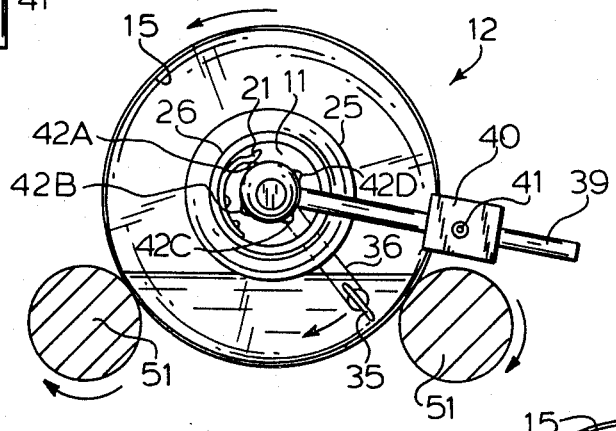
FIG.4
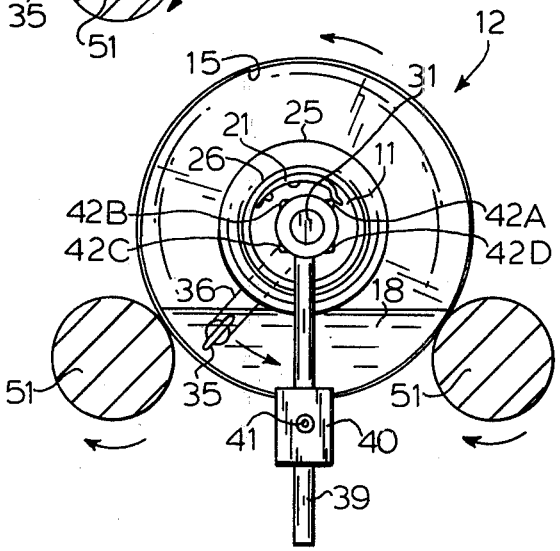
FIG.3

GRAVITY-INDUCED STIRRING DEVICE FOR ROTATING LIQUID CONTAINERS

BACKGROUND OF THE INVENTION

The present invention relates to a stirring device for stirring liquid in a rotating container, and more particularly, concerns such a stirring device which is operable with such a rotating container due to gravity inducement.

Rotatable containers which are employed in solid surface cell culture production are commonly referred to as "roller bottles." These bottles, made of glass, plastic or other suitable material, have their interior surfaces treated for the culturing of cells. Roller bottles, and the tissue culturing processes, are generally performed within the laboratory or other suitable locations.

In utilizing the roller bottle technique for culturing of cells, the preferably cylindrically shaped bottle is placed on its rounded peripheral surface between two rolling bars which impart rotary motion to the bottle. A liquid growth medium is placed inside the bottle, generally so that the liquid medium does not reach the level of the bottle opening. Upon rotation of the bottle, the liquid growth medium contacts the treated interior surfaces of the bottle in a constant wetting motion. This type of motion is conducive to the growth of cells on the interior surface of the bottle.

In many instances, the nature of the cells to be cultured or the cell culture system necessitates the use of a stirring device inside the liquid medium. This is the case of cells growing in suspension or cells attached to microcarrier beads that are suspended inside the liquid medium. Such a stirring device has to impart some stirring motion to the liquid which is different from the rotary motion of the liquid caused by the rotating roller bottles. In other words, a stirring device would move faster or slower than the rotating bottle in order to cause this stirring movement.

Heretofore, no known stirring devices have been adapted to a roller bottle. Existing stirring devices are placed inside a non-movable container. Such items as spinner flasks are far from being ideal as they create problems when they are placed in an incubator. For instance, many of these devices generate heat, and when placed inside an incubator increase its temperature, thereby making it necessary to recalibrate the incubator temperature control. Furthermore, the known stirring devices have flat bottoms which are inappropriate for keeping the cells in motion. Moreover, these known stirring devices may add expense to the assembly and its operation. Accordingly, the present invention is directed to overcoming these deficiencies in the heretofore known stirring devices and to provide a new device that stirs the liquid growth medium inside a liquid container such as a rotating roller bottle.

SUMMARY OF THE INVENTION

A device for stirring liquid in a rotating container comprises movable stirring means adapted to be positioned inside a rotatable container and impart stirring movement to liquid placed therein. Means is associated with the container and the stirring means for moving the stirring means with said container for only a portion of a revolution of the container when rotating. Also, this associated means permits the increasing gravitational force thereon due to rotation to discontinue the movement of the stirring means and cause a gravitational rotation of the stirring means in a counter-direction to that of the rotating container. In this regard, liquid inside the container is adapted to be stirred.

In a preferable embodiment of the present invention, the device for stirring liquid includes a stopper for positioning in fluid-tight sealing engagement in an opening in the liquid container and a movable stirrer blade for positioning inside the container. An axle has one end fixedly connected to the stirrer, is rotatably connected to the stopper and includes a plurality of teeth members spaced around its surface near the connecting location to the stopper. A counterbalance armature is fixed to the other end of the axle. Connected to the stopper is a resilient spring adapted to be rotated therewith and for biased contact against one of the tooth members on the axle for rotating the axle with the stopper for only a portion of a revolution. This spring also permits the increasing gravitational force on the armature due to rotation to overcome the contact force exerted by the spring against the contacted tooth member and cause a gravitational rotation of the axle and stirrer in a counterdirection to that of the rotating container. Thus, liquid inside the container is adapted to be stirred.

Another aspect of the present invention is a rotatable liquid container assembly with a gravity-effectuated stirring mechanism substantially as described above.

In accordance with the principles of the present invention, stirring is imparted to liquid placed in a rotating container without the need for powered-type stirring devices. The present invention relies upon the gravitational forces to cause a stirring movement within the liquid inside the roller bottle. This offers the significant advantage of simplicity of operation with concomitant reduction in expense, since the present stirring mechanism is gravity powered rather than some type of automated power such as electrical or pneumatic. Furthermore, this type of gravity-induced stirring mechanism can be used on roller bottles which are to be placed in an incubator inasmuch as there will be no substantial effect on the temperature inside the incubator as a result of using this stirring mechanism. As will be seen from a further reading of the detailed description of the invention, other advantages are offered as well.

BRIEF DESCRIPTION OF THE DRAWINGS

FIG. 2 is a cross-sectional view taken along line 2—2 of FIG. 1;

FIG. 3 is an end view of the stirring device of FIG. 1 with the roller bottle positioned on rotating roller bars;

FIG. 4 is an end view of the stirring device similar to that of FIG. 3, but illustrating the partial revolution of the stirring device just before the stirrer blade rotates in a direction counter to the rotating roller bottle;

DETAILED DESCRIPTION

Figure 1:
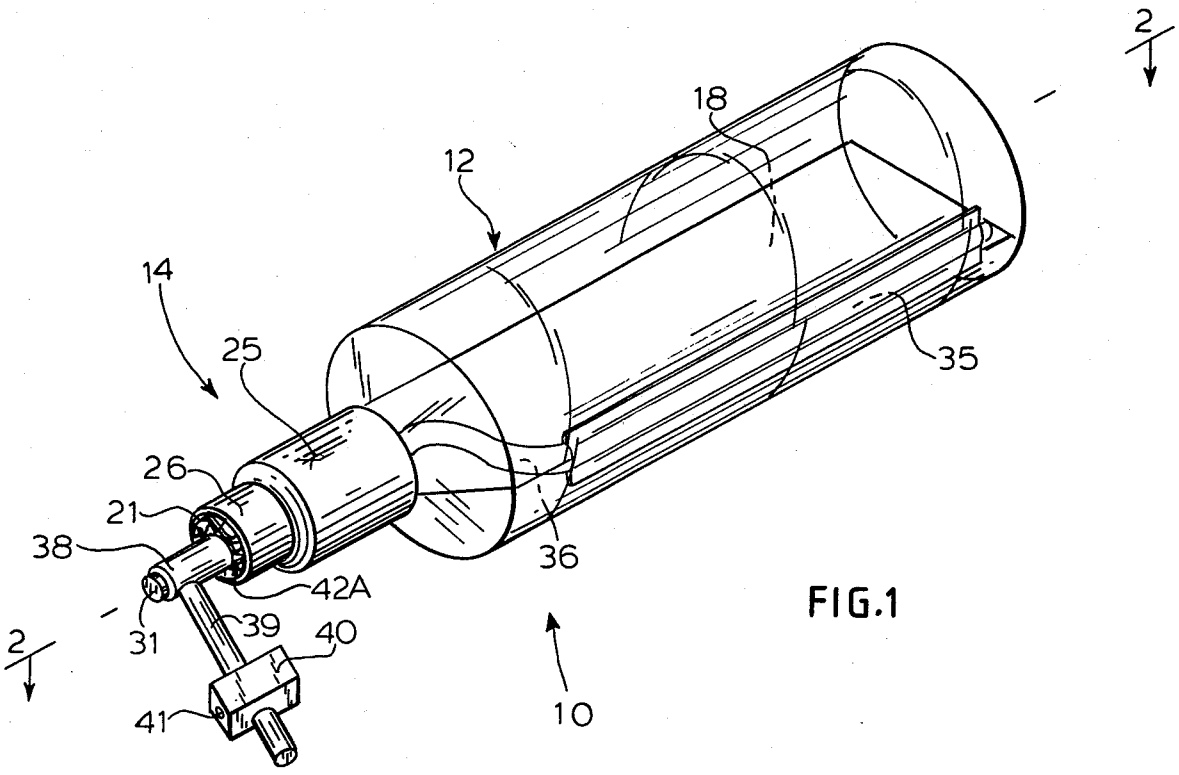
FIG. 1 is a perspective view of one configuration of a roller bottle with the preferred stirring device of the present invention.

While the present invention is satisfied by embodiments in many different forms, there is shown in the drawings and will herein be described in detail a preferred embodiment of the invention, with the understanding that the present disclosure is to be considered as exemplary of the principles of the invention and is not intended to limit the invention to the embodiment illustrated. The scope of the invention will be measured by the appended claims and their equivalents.

Adverting to the drawings, particularly to FIGS. 1, 2 and 3, there is illustrated a rotatable liquid container such as a roller bottle assemly 10 which is utilized in the culturing of cells. Roller bottle assembly 10 consists of two general components, namely, a roller bottle 12 and a stirring mechanism 14.

Roller bottle 12 is preferably a cylindrically shaped container which is rotatable around its circular, peripheral surface. Roller bottle 12 has a liquid placement opening 11 through one end lying substantially along the longitudinal axis of the bottle. Screw threads 13 are provided around opening 11 to receive a cap for closure purposes. The interior wall surface 15 of the roller bottle has been preferably uniformly treated for the culturing of cells and also to enhance cell adhesion thereto.

Stirring mechanism 14 generally consists of a stopper or closure body 26 which is intended to be inserted into opening 11 of the roller bottle. Surrounding body 26 is a closure retainer 25 which has internal threads for mating with threads 13 around the opening of the roller bottle. A closure seal 27, such as a rubber or other elastomeric gasket, is fitted between stopper 26 and the mouth of the roller bottle opening 11 so as to effectuate a liquid-tight sealing engagement between the stopper and the roller bottle.

A shaft or axle 31 is positioned through stopper 26 so that it can rotate freely with respect to the stopper. To facilitate this free movement, washers 32 and locking snap-rings 34 are placed around axle 31 and against stopper 26 to allow the axle to rotate but to remain in fixed position with respect to the longitudinal direction. A stirrer blade 35 is connected to axle 31 by virtue of a connecting shaft 36. As can be seen in the drawings, blade 35 is movable with shaft 31 and is of an elongate nature so as to have a length almost as long as the length of the roller bottle. Blade 35 is also positioned eccentrically with respect to the longitudinal axis of the roller bottle so that the bottom portion of the blade is positioned adjacent interior wall 15 of the roller bottle which allows the blade to stir the liquid very close to the culturing surface. Accordingly, although the axle lies substantially at and parallel with the axis of rotation of the roller bottle, the stirrer blade is adapted to rotate very close to the interior wall inside the roller bottle.

Surrounding the outer end of axle 31 is a collar 38 which is fixed to rotate with axle 31. Extending from collar 38 is a counterbalance armature 39 which lies outside of the roller bottle and is fixedly connected to collar 38 by appropriate screw threads or the like. Armature 39 extends substantially radially from collar 38 and forms a moment arm for imparting rotary motion to the stirrer blade. Preferably, an additional weight 40 is positioned on armature 39 and may be adjusted along the length of the armature to thereby vary the moment area of armature 39 around its center axis. A set screw 41 is provided for tightening the weight in a selected position along the length of the armature.

Around the outside surface of collar 38, attached to and as part of axle 31, is a plurality of teeth members 42*a*, 42*b*, 42*c* and 42*d*. These teeth members are positioned adjacent the outside surface of stopper 26. A resilient detent spring 21 is connected to an inside peripheral surface of stopper 26 so that the spring will rotate with the stopper. Detent spring 21 is adapted for biased contact against one of the tooth members at a time around the axle, such as with tooth member 42*a* as seen in FIG. 3. Spring 21 is designed to remain in contact with one of the tooth members for only a portion of a revolution of the roller bottle when rotating. The function of the stirring mechanism in the roller bottle will now be described.

Figure 5:
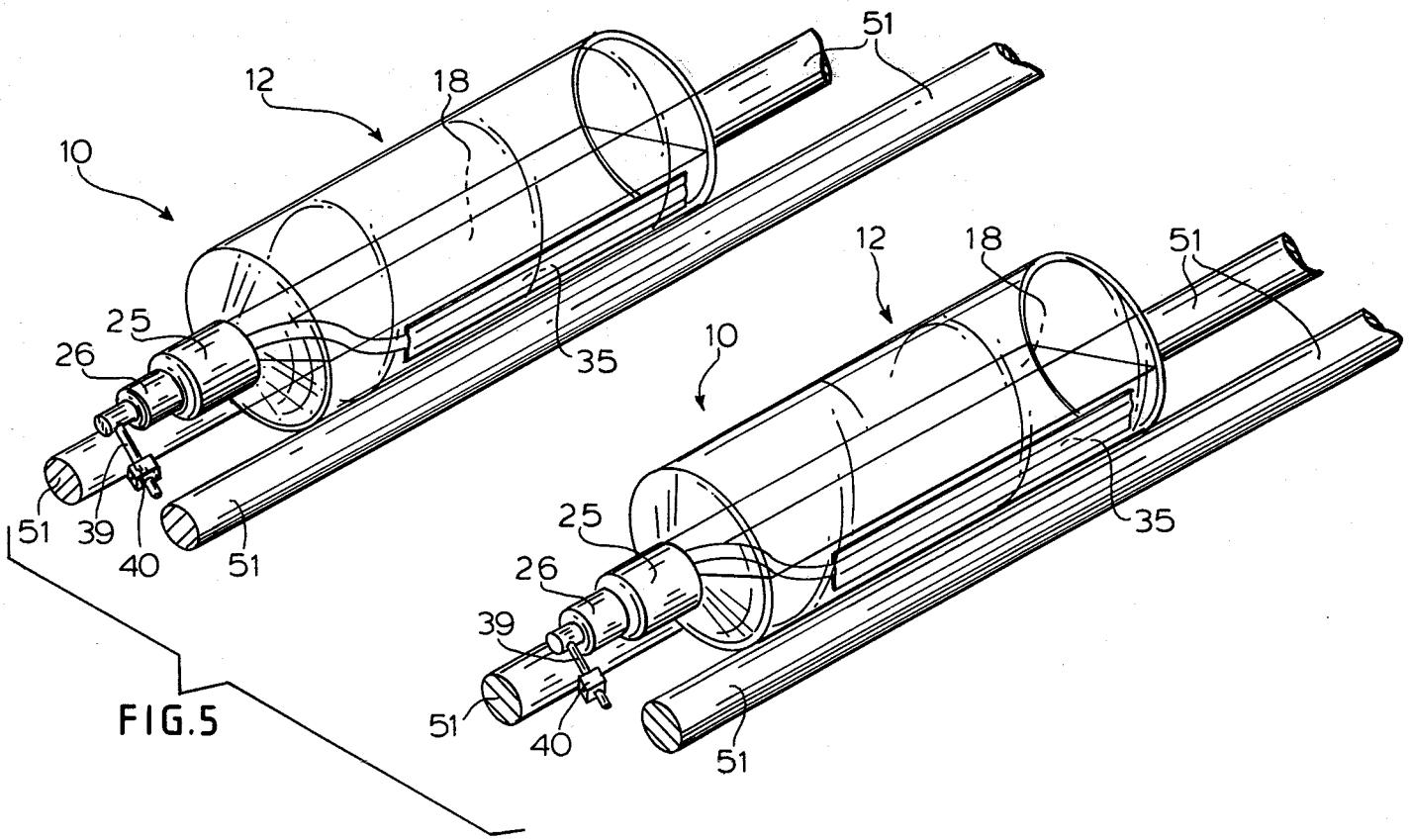
FIG. 5 is a perspective view illustrating two of the roller bottles side by side on a roller bar rotating mechanism.

When the roller bottle assembly is set in motion, roller bottle 12 rotates as shown in FIGS. 3, 4 and 5 (FIG. 5 showing two such roller bottle assemblies side by side). Liquid growth medium 18 has been placed into roller bottle 12 and rotation is imparted through contacting roller bars 51. These roller bars may be inside an incubator (not shown) if a temperature controlled environment is desired. The stirring mechanism remains in equilibrium in the position shown in FIG. 3 with detent spring 21 rotating until it contacts one of the teeth members, such as members 42*a*. As the roller bottle continues to rotate, detent spring 21 transmits rotational force through tooth member 42*a* to axle 31; with this rotation, counterbalance armature 39 also rotates, as does shaft 36 and stirrer blade 35. It is appreciated that, as armature 39 rotates upwardly, the gravitational forces thereon are constantly increasing. This is due to the increasing length of the horizontal component of the armature and weight which increases the moment arm exerted against the detent spring to overcome the spring force. This rotation continues until the stirring mechanism has reached the forward position shown in FIG. 4. At this point, the gravitational forces on the stirring mechanism, which includes the weight of counterbalance armature 39 and weight 40, equal the spring forces applied by detent spring 21 to tooth member 42*a*. As rotation of the roller bottle passes this point, the gravity force exceeds the spring force, whereby contact of detent spring 21 with tooth member 42*a* is released. This causes a gravitational rotation of axle 31, stirrer blade 35 and counterbalance armature 39 with weight 40 in a counterdirection to that of the rotating roller bottle. In the embodiment being described, the stirring mechanism swings back in oscillatory fashion to its aft position as illustrated in FIG. 3. As a result, and as the roller bottle continues to rotate, detent spring 21 then contacts tooth member 42*b*, and the cycle is repeated. The entire aforementioned stirring procedure is also repeated with respect to teeth members 42*c*, 42*d*, and then 42*a*, etc., thus applying a continual stirring action to liquid 18 in the roller bottle.

Although in this embodiment being described, four teeth members are shown, it is appreciated that the number of teeth members in the design of this stirring mechanism may be varied, depending on the desired frequency and amplitude of the stirring stroke. However, only one tooth member or the like would be satisfactory with there being only one counter-rotating stirring action during each complete revolution of the rotating roller bottle. Also, the stroke of the stirring mechanism may be adjusted by varying the lead angle between stirrer blade 35 and counterbalance armature 39 or by adjusting the position of weight 40 on counterbalance armature 39.

Figure 6:
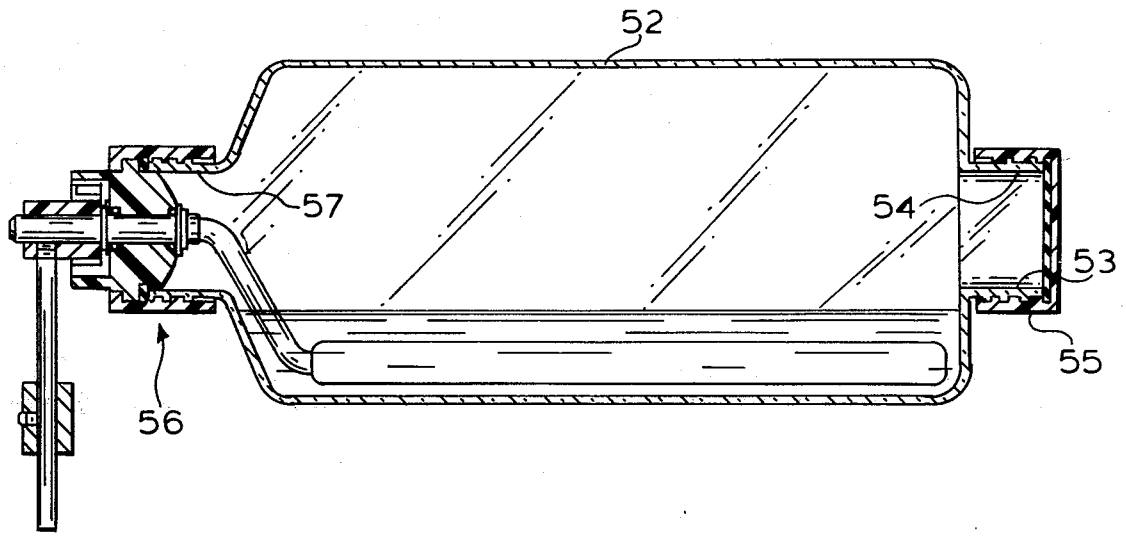
FIG. 6 is an alternate embodiment of a roller bottle with more than one liquid opening.

FIG. 6 illustrates an alternative construction of a roller bottle 52 which contains more than one opening therethrough. A threaded neck 53 is provided with an opening 54 at one end of roller bottle 52. A cap or closure 55, with mating internal threads, is provided to close this opening. At the other end of roller bottle 52 a stirring mechanism 56 is provided in an opening 57, the stirring mechanism being substantially as described above. The advantage of this alternate construction roller bottle is that it enables the inoculation of cells and medium through opening 54 without the removal of stirring mechanism 56 from the opposite end.

Thus, there is provided according to the present invention a gravity-induced stirring device for stirring liquid in rotating liquid containers. No additional power, such as electrical, pneumatic or vacuum, is required inasmuch as the structure of the present invention relies on gravitational forces to effectuate the stirring of the growth medium concurrent with the rotation of the roller bottles.

What is claimed is:

1. A device for stirring liquid in a rotating container having an opening for the placement of liquid therein comprising:

a stopper adapted to be positioned in fluid-tight sealing engagement in the opening in said container and rotate therewith;

a movable stirrer adapted to be positioned inside said container and impart stirring movement to liquid placed therein;

an axle having one end fixedly connected to said stirrer but rotatably connected to said stopper and adapted to be positioned in said container so that it lies substantially at and parallel with the axis of rotation of said container;

a counterbalance armature adapted to be positioned outside of said container and connected to the other end of said axle so that it extends substantially radially therefrom; and operable resilient contact means between said stopper and said axle for rotating said axle with said stopper for only a portion of a revolution and for permitting the increasing gravitational force on said armature due to rotation to overcome the contact force exerted by said resilient contact means and cause a gravitationally-induced rotation of the axle and stirrer in a counterdirection to that of said rotating container whereby liquid inside said container is adapted to be stirred, said resilient contact means adapted to permit said counter-rotation at least once during each complete revolution of the rotating container.

2. The device of claim 1 wherein said stirrer includes an elongate blade for movement within the liquid in the container.

3. The device of claim 1 wherein said stirrer is eccentrically connected to said axle and adapted to lie adjacent the interior wall of said container for stirring purposes.

4. The device of claim 1 wherein said axle is integrally connected to said stirrer.

5. The device of claim 1 wherein said operable resilient contact means includes a resilient spring connected to said stopper and adapted to be rotated therewith, said spring adapted for biased contact against a tooth member associated with said axle during said portion of a revolution in order to turn said axle with said stopper during said portion, the force exerted by said spring against said tooth member adapted to be overcome by the increasing gravitational force on said armature to thereby release the spring from contact with the tooth member and allow the axle and stirrer to freely counter-rotate under gravitational force with respect to the rotating container.

6. The device of claim 5 wherein there is a plurality of teeth members spaced around said axle for engagement by said spring so that the counter-rotation of said stirrer is effectuated a plurality of times during each complete revolution of the rotating container.

7. The device of claim 1 wherein said armature includes a position adjustable weight therewith to vary the moment arm of said armature and thereby adjust the stroke arc of the stirrer inside said container.

8. A device for stirring liquid in a rotating container comprising:

movable stirring means adapted to be positioned inside a rotatable container and impart stirring movement to liquid placed therein; and means associated with said container and said stirring means for moving said stirring means with said container for only a portion of a revolution of said container when rotating and for permitting increasing gravitational force thereon due to rotation to discontinue the movement of said stirring means and cause a gravitationally-induced rotation of the stirring means in a counterdirection to that of said rotating container whereby liquid placed inside said container is adapted to be stirred.

9. A device for stirring liquid in a cylindrically shaped roller bottle for rotation around its circular peripheral surface and having a liquid placement opening through one end of said roller bottle substantially along the longitudinal axis thereof, said device comprising:

a stopper adapted to be positioned in fluid-tight sealing engagement in the opening in said roller bottle and rotate therewith;

a movable, elongate stirrer blade adapted to be positioned inside said roller bottle and rotate adjacent the interior wall of said roller bottle for stirring purposes;

an axle having one end fixedly connected to said stirrer so that said stirrer is located eccentrically to said axle, said axle rotatably connected to said stopper and adapted to be positioned in said roller bottle so that it lies substantially at and parallel with the axis of rotation of said roller bottle;

said axle including a plurality of teeth members spaced around its surface near the connecting location to said stopper;

a counterbalance armature adapted to be positioned outside of said roller bottle and fixedly connected to the other end of said axle so that it extends substantially radially therefrom; and a resilient spring connected to said stopper and adapted to be rotated therewith, said spring adapted for biased contact against one of said tooth members on said axle for rotating said axle with said stopper for only a portion of a revolution and for permitting increasing gravitational force on said armature due to rotation to overcome the contact force exerted by the spring against said contacted tooth member and cause a gravitationally-induced rotation of the axle and stirrer in a counterdirection to that of said rotating roller bottle whereby liquid inside said roller bottle is adapted to be stirred, with a counter-rotation of said stirrer adapted to occur after the spring breaks biased contact with each tooth member as rotation of the roller bottle continues.

10. A rotatable liquid container assembly with a gravity-induced stirring mechanism comprising:

a liquid container adapted to be rotated with liquid therein;

movable stirring means positioned inside said container for imparting stirring movement to said liquid;

means associated with said container and said stirring means for moving said stirring means with said container for only a portion of a revolution of said container when rotating and for permitting increasing gravitational force thereon due to rotation to discontinue the movement of said stirring means and cause a gravitationally-induced rotation of the stirring means in a counterdirection to that of said rotating container whereby liquid placed inside said container is adapted to be stirred.

11. The container assembly of claim 10 wherein said container includes only one opening for the placement of liquid therein, said opening having the means for moving said stirring means serving as a liquid-tight stopper for closing said opening.

12. The container assembly of claim 11 which includes a second opening for access to the interior of said container without having to remove said stirring means.

* * * * *